United States Patent [19]

Winter et al.

[11] Patent Number: 4,635,449

[45] Date of Patent: Jan. 13, 1987

[54] SUPPLEMENTAL COOLING DEVICE FOR A REFRIGERATING UNIT

[76] Inventors: Scott H. Winter, 11 Broadway; Mark S. Carbone, 107 6th St., both of Verplanck, N.Y. 10596

[21] Appl. No.: 707,247

[22] Filed: Mar. 1, 1985

[51] Int. Cl.[4] ..... F25B 1/00

[52] U.S. Cl. ..... 62/467; 62/119; 62/332; 62/434

[58] Field of Search ..... 62/332, 434, 467, 335, 62/119; 165/121.19

[56] References Cited

U.S. PATENT DOCUMENTS

| | | | |
|---|---|---|---|
| 2,515,825 | 7/1950 | Grant | 62/434 |
| 2,530,681 | 11/1950 | Clancy | 62/335 |
| 2,691,273 | 10/1954 | Kramer | 62/333 |
| 2,722,108 | 11/1955 | Hailey | 62/434 |
| 3,277,668 | 10/1966 | Foster | 62/434 |
| 4,182,409 | 1/1980 | Robinson, Jr. | 165/104.21 |
| 4,406,138 | 9/1983 | Nelson | 62/119 |

*Primary Examiner*—Ronald C. Capossela
*Attorney, Agent, or Firm*—Karl F. Milde, Jr.

[57] ABSTRACT

A method and apparatus for utilizing the cool outdoor air or other cooling sources for cooling a volume are disclosed. The system comprises at least two coils suitable fluid pipe line, fluid and a circulator pump. In the preferred embodiment, indoor and outdoor coils and the circulator are connected by circulation piping containing a heat transfer fluid, the fluid being isolated from ambient air. In winter the circulator pump is activated and warm fluid flows through the outdoor coil, causing the fluid in the coil to release heat, the coil fluid flows through the indoor coil, causing the fluid in the indoor coil to absorb heat. Such a system can be used to cool a volume when the ambient, outdoor air is cooler than the air within the volume.

3 Claims, 1 Drawing Figure

SUPPLEMENTAL COOLING DEVICE FOR A REFRIGERATING UNIT

BACKGROUND OF THE INVENTION

1. Field of the Invention

The field of art which this invention pertains is heat exchange utilizing an intermediate fluent material for receiving and discharging heat based on a closed loop cooling system in conjunction with a condensing and evaporating system.

2. Description of the Prior Art

It has been proposed to utilize a condensing and evaporating system to provide cooling to refrigerated area.

However, what has been lacking in the prior art is a efficient system of utilizing cool winter air or other cooling source in a heat exchange system which is both efficient and yet relatively simple in structure to make its use economically feasible.

BRIEF SUMMARY OF THE INVENTION

The present invention overcomes the difficulties of utilizing the cool outdoor air or other cooling source for cooling an area in conjunction with conventional refrigeration systems and further overcomes possible damage to compressor, caused by liquid slugging, liquid slugging occur during cold weather. By deactivating the condensing and evaporating cooling system and activating the closed loop cooling system, liquid slugging is elimated. According to the present invention, a single, cycle, motor driven circulating pump of simple operation and design is described to collect heat from the volume or area to be cooled. The heat transfer system described comprises at least one liquid circulator pump, an indoor coil, an outdoor coil, an a heat transfer fluid, and suitable pipe line. In conjunction with conventional cooling apparatus, the use of such systems can realize substantial savings in cost of cooling structures.

The foregoing and other objects, features and advantages of the present invention will become more apparent in light of the folling detailed description of preferred embodiments thereof as discussed and illustrated in the accompanying drawings.

BRIEF DESCRIPTION OF THE DRAWING

The single FIGURE illustrates loop cooling system in use with a refrigerated area inside a building structure.

DESCRIPTION OF THE PREFERRED EMBODIMENT

Figure 1:
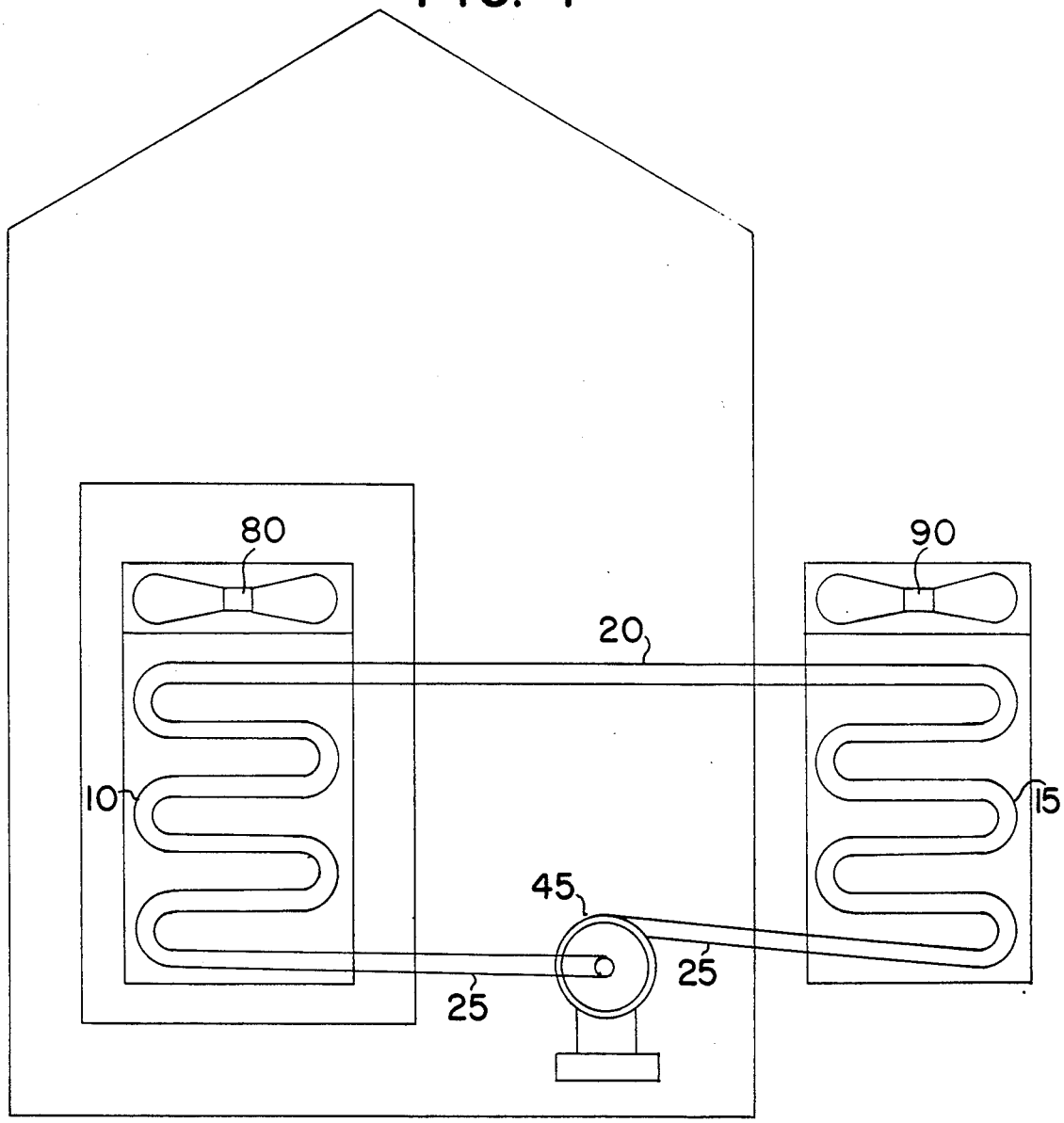

Exemplary apparatus demonstrating the instant invention comprises a circulator pump for circulating heat transfer fluid through the indoor and outdoor coils, thus transferring heat from the refrigerated or air conditioned area inside the building structure, to outdoors.

The heat exchange coils may be any metal suitable for such use provided they have such properties as resistance to corrosion to the heat transfer fluids and high thermal conductivity, such as aluminum or copper.

As shown in the FIGURE the invention basically comprises a system of circulation pipes, coils, and circulator pump of simple and efficient design. The system is a single cycle system being capable of supplying a low temperature air for the area within enclosure 50 to be cooled. In the FIGURE the heat transfer fluid 20 which can be any fluid capable of transferring heat but preferably a liquid such as water or a water ethylene glycol mixture (preferably 50% water, 50% ethylene glycol, by volume) passes through the respective circulation pipes 25. The indoor coil 10 within the enclosure 50 acts as an evaporator and the outdoor coil 15 outside the building structure 60 acts as an condenser, air passes over the respective coils 10 and 15, transferring heat to or from the heat transfer fluid 20 in the circulation pipes 25 and 25 may be any diameter and size to accomplish the purposes of the invention and would be well within the preview of one skilled in this art. The circulation pipes may be any suitable material to convey the heat transfer fluid such as metal or plastic. Similarly, the metal coils funtioning as heat exchanges and may be any metal suitable for such use provided they have such properties as resistance to corrosion to the heat transfer fluids and high thermal conductivity such as aluminum or copper.

The FIGURE demonstrates the operation of the closed loop in the cooling mode. In such mode, the circulator pump 45 is activated and the heat transfer fluid, for example, water is circulated by circulator pump 45 through coils 10 and 15 and indoor coil 10 absorbs heat from the area to be cooled and fan 80 passes warm air over the cool indoor coil 10, the outdoor coil 15 releases heat into the cool outdoor air and fan 90 passes cool air over the warm outdoor coil 15.

From the drawing and the remainder of the disclosure, it can be seen that what has been invented is an efficient simple cooling system. Accordingly, not only energy saved based on the lessened degree of cooling required by the condensing and evaporating cooling system working in its cooling of an area, but compressor life is also saved by using the system disclosed, instead of using the conventional condensing and evaporating system. Furthermore, the same system can be used for space, area, volume, water, air, solid, liquid, gas, animal, vegatable or mineral cooling providing even greater simplicity. This clearly provides a myriad of advantages over conventional systems of the prior art (for example condensing and evaporating systems) which have countless problems.

Although this invention has been shown and described with respect to a preferred embodiment thereof, it should be understood by those skilled in the art that various changes and modifications in the form and detail thereof may be made therein without departing from the spirit and scope of the invention.

Having thus discribed a typical embodiment of my invention, that which I claim as new and desire to secure by Letters Patent of the United States is:

1. In a refrigerating unit comprising an enclosure and fluid evaporating and condensing means for cooling the air within said enclosure, the improvement comprising supplemental means for cooling said air within said enclosure, including:

(a) an outdoor coil accessable to the outside ambient air;

(b) an indoor coil inside the enclosure;

(c) a liquid circulator connected in series between said indoor coil and said outdoor coil and having a liquid circulating pump; and (d) a working liquid contained within said indoor and outdoor coils and within said liquid circulator;

whereby said working liquid transmits heat from said indoor coil to said outdoor coil when the outside ambient air is cooler than said air within said enclosure.

2. The improvement defined in claim 1, wherein said supplemental cooling means further includes means for directing a stream of air within said enclosure along a path in heat exchange relationship with said indoor coil.

3. The improvement defined in claim 1, wherein said supplemental cooling means further includes means for directing a stream of ambient air along a path in heat exchange relationship with said outdoor coil.

* * * * *